US008636550B2

(12) United States Patent
Onoda et al.

(10) Patent No.: US 8,636,550 B2
(45) Date of Patent: Jan. 28, 2014

(54) PROTECTIVE CAP FOR PREVENTION OF OBLIQUE TIGHTENING OF FUSIBLE LINK DIRECTLY MOUNTED ON BATTERY

(75) Inventors: Shinya Onoda, Makinohara (JP); Motofumi Kato, Makinohara (JP); Yoshinori Ishikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/585,078

(22) Filed: Aug. 14, 2012

(65) Prior Publication Data

US 2012/0309239 A1 Dec. 6, 2012

Related U.S. Application Data

(63) Continuation of application No. PCT/JP2011/053605, filed on Feb. 15, 2011.

(30) Foreign Application Priority Data

Feb. 15, 2010 (JP) ..... 2010-030194

(51) Int. Cl.
*H01R 4/38* (2006.01)

(52) U.S. Cl.
USPC ..... 439/766; 439/762

(58) Field of Classification Search
USPC ..... 439/766, 755, 756, 757, 758, 762, 504; 337/189, 188
See application file for complete search history.

(56) References Cited

U.S. PATENT DOCUMENTS

| | | | | |
|---|---|---|---|---|
| 6,512,443 | B1 | 1/2003 | Matsumura et al. | |
| 6,939,167 | B2 * | 9/2005 | Kosuge | 439/522 |
| 2002/0134572 | A1 | 9/2002 | Matsumura | |

FOREIGN PATENT DOCUMENTS

| | | | |
|---|---|---|---|
| EP | 1239506 | A2 | 9/2002 |
| JP | 62-48668 | U | 3/1987 |
| JP | 10092484 | A | 4/1998 |
| JP | 2000331591 | A | 11/2000 |
| JP | 2010-21055 | A | 1/2010 |
| JP | 2010-40254 | A | 2/2010 |
| JP | 2011165611 | A * | 8/2011 |

OTHER PUBLICATIONS

International Search Report dated Apr. 11, 2011 issued in International Application No. PCT/JP2011/053605 (PCT/ISA/210).
Written Opinion dated Apr. 11, 2011 issued in International Application No. PCT/JP2011/053605 (PCT/ISA/237).
Office Action, dated Dec. 3, 2013, issued by the Japanese Patent Office in counterpart Japanese Patent Application No. 2010-030194.

* cited by examiner

*Primary Examiner* — Hae Moon Hyeon
(74) *Attorney, Agent, or Firm* — Sughrue Mion, PLLC

(57) ABSTRACT

A protective cap protects a fusible link formed with a connection hole. A protective cap part is disposed on an extension of an axis of a stud bolt of a power source. The protective cap part is formed with a tool insertion hole into which a tool used for fitting a nut with the stud bolt is inserted. The stud bolt is inserted through the connection hole. A nut holder is provided inside the protective cap part. The nut holder holds the nut in a state where an axis of the nut is parallel to the axis of the stud bolt.

6 Claims, 18 Drawing Sheets

PROTECTIVE CAP FOR PREVENTION OF OBLIQUE TIGHTENING OF FUSIBLE LINK DIRECTLY MOUNTED ON BATTERY

CROSS REFERENCE TO RELATED APPLICATION

This application is a continuation of PCT application No. PCT/JP2011/053605, which was filed on Feb. 15, 2011 based on Japanese Patent Application (No. 2010-030194) filed on Feb. 15, 2010, the contents of which are incorporated herein by reference. Also, all the references cited herein are incorporated as a whole.

BACKGROUND OF THE INVENTION

1. Technical Field

The present invention relates to prevention of oblique tightening of a fusible link directly mounted on a battery, and particularly to a protective cap for prevention of oblique tightening constructed so that a nut can be prevented from being obliquely tightened.

2. Background Art

A vehicle of an automobile is equipped with a battery as a power supply source, and a fusible link with a built-in fuse is electrically connected to a battery post of the battery through a battery terminal. As the fusible link directly mounted on the battery, for example, a fusible link described in JP-A-2000-331591 as shown in FIG. 18 is used conventionally.

FIG. 18 is an exploded perspective view of a fusible link directly mounted on a battery described in JP-A-2000-331591. In FIG. 18, a fusible link 30 directly mounted on a battery is electrically connected to a battery post 10P of the battery 10 through a battery terminal 20.

The battery 10 has a rectangular parallelepiped and the battery post 10P is erected in the vicinity of the upper end. The battery terminal 20 is crimped onto this battery post 10P.

The battery terminal 20 includes a crimp hole 20H for inserting the battery post 10P of the battery 10 in the center, an adjusting screw 20N for adjusting a diameter of the crimp hole 20H small and large, and a power source side stud bolt 20S inserted into a connection hole 32Ah of a power source side terminal block 32A of the fusible link 30.

The fusible link 30 is constructed of a fuse body 32 and a resin case 34 with which this fuse body 32 is partially covered by resin molding, and the apex of the fusible link 30 is covered with a protective cap 50. The fuse body 32 is made by punching one conductive plate, and is constructed of the power source side terminal block 32A with a rectangular shape, a narrow fusible body 32F joined to the power source side terminal block 32A, and substantially a rectangular wire harness side terminal block 32B joined to the fusible body 32F. The power source side terminal block 32A, the fusible body 32F and the wire harness side terminal block 32B are arranged on substantially the same plane. The fusible body 32F is not shown, but is presence inside a transparent cover 30F.

The connection hole 32Ah is formed in the power source side terminal block 32A and also, both of the front and back portions are excluded from the resin case 34 to a range corresponding to space into which a tool (an impact wrench) is inserted around the connection hole 32Ah.

The wire harness side terminal block 32B has a bolt hole 32Bh, and a stud bolt 32S protrudes upward (the side opposite to the battery) in this bolt hole 32Bh.

The resin case 34 exposes the front and back sides of the power source side terminal block 32A and the front side of the wire harness side terminal block 32B in the fuse body 32 from the resin case 34 and thereby, the exposed portion is formed as an electrical connection. Also, the front and back sides of the fusible body 32F are exposed from the resin case 34, and the transparent covers 30F are respectively disposed over the front side of the fuse body 32 and under the back side of the fuse body 32, and appearance of a fusion part of the fusible body of the inside can be visually checked through the transparent covers 30F. A heat-radiating fin is formed on a surface of the resin case 34. The resin molding is performed after the stud bolt 32S is attached to the bolt hole 32Bh of the wire harness side terminal block 32B.

A wire harness side terminal 40 is fitted into the stud bolt 32S and a nut is screwed to the stud bolt 32S and thereby, the wire harness side terminal 40 is electrically connected to the stud bolt 32S.

The protective cap 50 is means for covering the fusible link 30, and is molded by resin. This protective cap prevents atmospheric dust etc. from entering and also prevents the human body from making contact to get an electric shock or cause an electric leak.

A conventional procedure of assembly in a vehicle is performed as described below.

First, the battery terminal 20 is fixed to the battery post 10P.

Next, the power source side stud bolt 20S of the battery terminal 20 is inserted into the connection hole 32Ah of the power source side terminal block 32A of the fusible link 30, and the nut N is screwed and tightened to the power source side stud bolt 20S, and the power source side terminal block 32A is electrically connected to the power source side stud bolt 20S.

Finally, the protective cap 50 is fitted into the fusible link 30 from the upper portion of the fusible link 30.

Thereafter, at the time of use, the wire harness side terminal 40 is fitted into the stud bolt 32S of the fusible link 30 and the nut is screwed to the stud bolt 32S and thereby, the wire harness side terminal 40 is electrically connected to the battery 10. In that case, the protective cap 50 may be detached temporarily, but it is desirable to be constructed so that a hinge is previously formed in a region of the protective cap 50 corresponding to the stud bolt 32S of the fusible link 30 and only the portion is turned around the hinge at the time of connection and only the region of the stud bolt 32S can be exposed.

In the case of fixing the battery terminal 20 to the battery post 10P, the battery post 10P is inserted into the crimp hole 20H of the center of the battery terminal 20 and the adjusting screw (nut) 20N is tightened from the side of a horizontal bolt, so that there is a low possibility that gravity acts on the nut and oblique insertion is performed and also, even if oblique tightening of the bolt and the nut occurs and the oblique tightening is noticed, a tightening method for decreasing a diameter of the crimp hole 20H is adopted, so that a tightening force is still small and the nut is returned and the tightening can be retried.

Also, since the wire harness side terminal 40 is fixed to the stud bolt 32S of the fusible link 30 in a place overhanging from the end of the battery 10, a sufficient visual check can be made, so that there is a low possibility that oblique tightening of the bolt and the nut at the time of tightening occurs and also, even if oblique tightening of the bolt and the nut occurs and the oblique tightening is noticed, a tightening force is small, so that the tightening can be retried.

On the other hand, in the case of fixing the nut N to the power source side stud bolt 20S of the battery terminal 20 through the connection hole 32Ah of the power source side terminal block 32A of the fusible link 30, the bulk of the resin case 34 becomes an obstacle and it is less visible and also, the nut N is inserted into the power source side stud bolt 20S in a perpendicular direction, so that it is difficult to notice oblique insertion and also tightening is performed by a large pressing force, so that when oblique tightening of the bolt and the nut occurs and the oblique tightening is noticed, an abnormal groove is formed in the bolt or the nut and it is difficult to retry the tightening.

Also, inventions for preventing an increase in resistance by oblique tightening of a bolt and a nut at the time of tightening have been proposed before now.

The first invention is that a peripheral wall is formed in the periphery of an erected bolt and when work is done with a torque wrench, the peripheral wall regulates oblique travel of the torque wrench so that the torque wrench does not become oblique.

The second invention is that the top of a bolt of a tightening part is changed into a long dog point shape and a nut is temporarily set at this top (see JP-A-10-92484).

However, these inventions for preventing the oblique tightening have poor workability and also, still have a possibility that the oblique tightening occurs due to deviation of a tool angle in the case of tightening the bolt and the nut.

SUMMARY OF THE INVENTION

It is therefore one advantageous aspect of the present invention to provide a protective cap in which workability is good and oblique tightening of a fusible link without occurrence of the oblique tightening can be prevented in the case of tightening a bolt and a nut.

According to one aspect of the invention, there is provided a protective cap for protecting a fusible link formed with a connection hole, comprising:

a protective cap part, disposed on an extension of an axis of a stud bolt of a power source, and formed with a tool insertion hole into which a tool used for fitting a nut with the stud bolt is inserted, the stud bolt inserted through the connection hole; and a nut holder, provided inside the protective cap part, and configured to hold the nut in a state where an axis of the nut is coaxial to the axis of the stud bolt.

An inner diameter of the tool insertion hole may be equal to an outer diameter of the tool.

The nut holder may include a plurality of lances which are erected inside the protective cap from a periphery of the tool insertion hole.

The protective cap may be configured such that: the lances include first lances and second lances which are shorter than the first lances, the first lances are configured to hold a first face of the nut at a side of the fusible link, and the second lances are configured to hold a second face of the nut opposite to the first face.

The protective cap may be configured such that: the lances further include third lances, and the third lances are configured to come in contact with the fusible link and to have an elastic force in a direction separating the protective cap from the fusible link in a state where the protective cap is attached to the fusible link.

The protective may further comprise a lid, configured to close the tool insertion hole; and a coupling band coupling the lid to the protective cap part.

According to the present invention, the tool insertion hole into which the tool for tightening the nut is inserted is included and the nut holder for horizontally holding the nut on a top of the power source side stud bolt is formed, so that by only inserting the tool into the tool insertion hole and rotating the tool, the nut is fitted into the stud bolt from the top of the stud bolt and moves and the nut can be tightened to the stud bolt easily without oblique travel.

Also, according to the present invention, the nut holder is formed of the lances erected inside the protective cap from the periphery of the connection hole, so that the nut holder can be manufactured integrally to the protective cap using the same resin material as that of the protective cap.

Also, according to the present invention, the first lance holds the surface of the side of the fusible link in the nut and the second lance holds the surface of the side of the protective cap in the nut, so that the nut can be fixed simply, stably and horizontally.

Also, according to the present invention, the lid for closing the tool insertion hole and the coupling band for coupling this lid to the protective cap are included, so that fear of losing the lid for closing the tool insertion hole is eliminated.

Also, according to the present invention, the anti-backlash lance lifts the protective cap in the direction of lifting the protective cap from the fusible link in the use state of the protective cap, so that backlash can be prevented even when there is clearance in the protective cap.

BRIEF DESCRIPTION OF THE DRAWINGS

FIG. 2A is a perspective view, and FIG. 2B is a sectional view taken on line A-A of FIG. 2A.

DETAILED DESCRIPTION OF THE EXEMPLARY EMBODIMENTS

A protective cap according to the invention in which workability is good and oblique tightening of a fusible link without occurrence of the oblique tightening can be prevented in the case of tightening a bolt and a nut will hereinafter be described with reference to the drawings.

Figure 1:
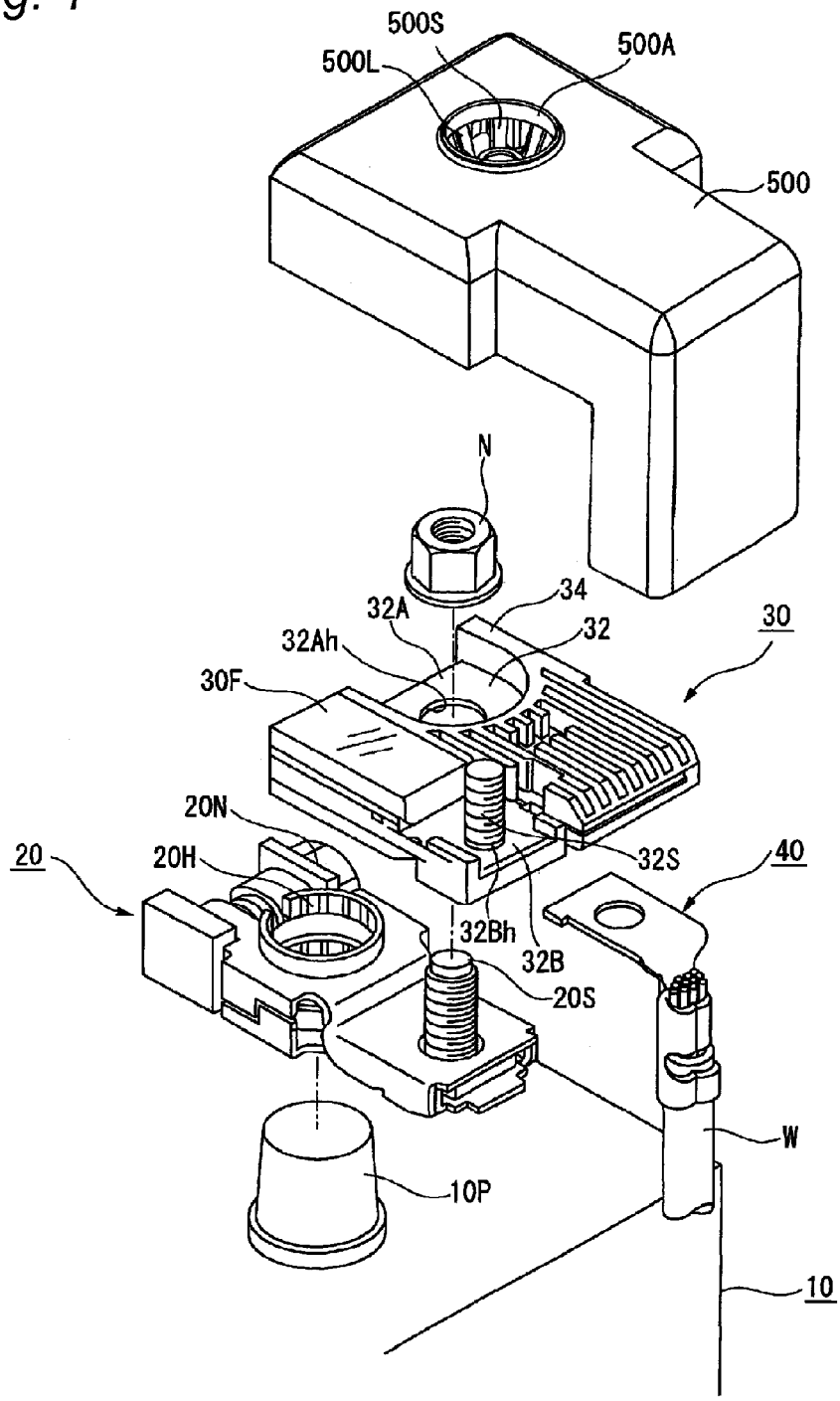
FIG. 1 is an exploded perspective view of a battery-direct-mounted fusible link and a protective cap according to the invention.

FIG. 1 is an exploded perspective view of a battery-direct-mounted fusible link including a protective cap according to the invention. Since a battery 10, a battery terminal 20, a battery-direct-mounted fusible link 30 and a wire harness side terminal 40 in FIG. 1 are the same as the conventional ones described in FIG. 18, overlap description is omitted.

Figure 18:
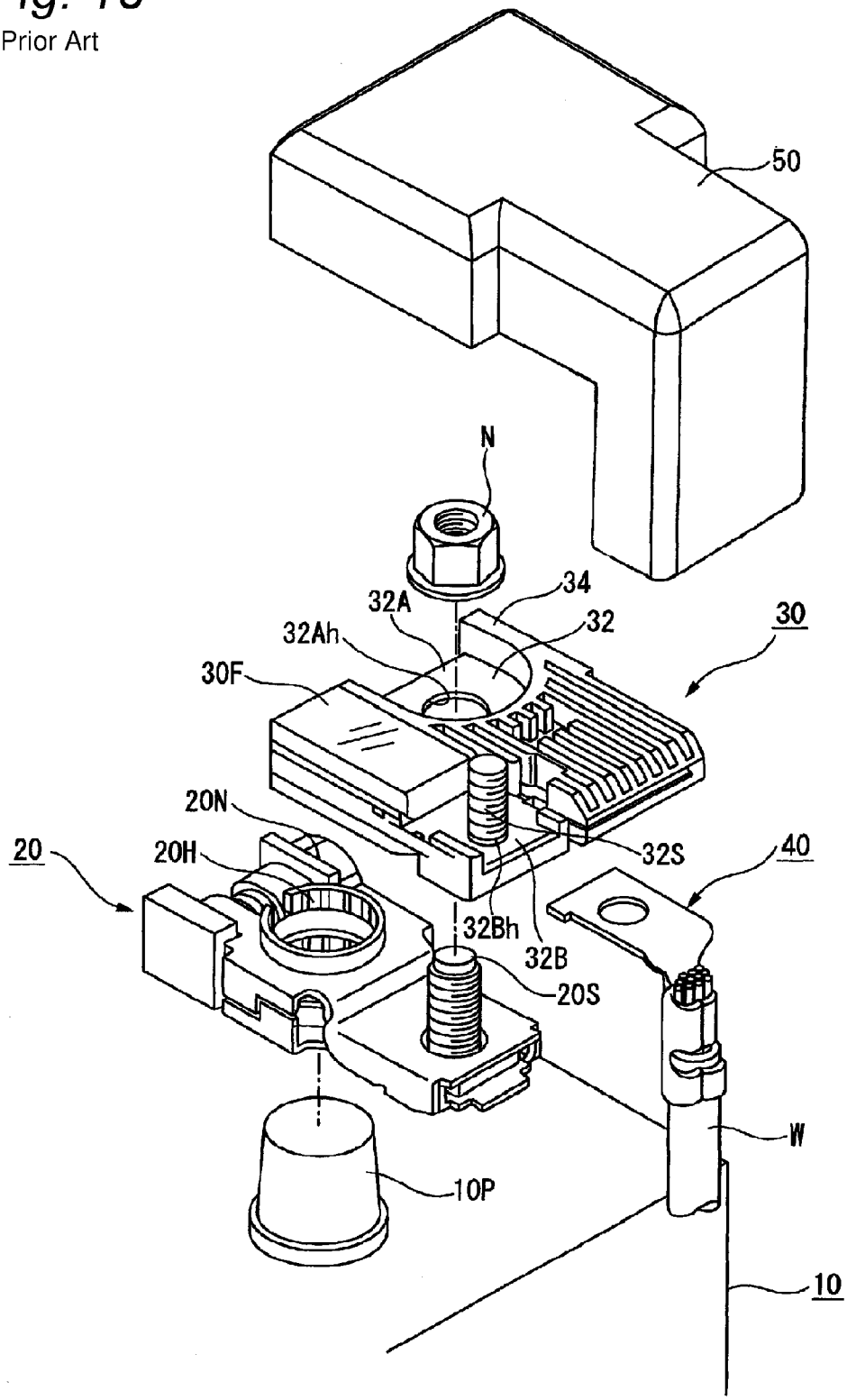
Fig. 18 Prior Art
FIG. 18 is an exploded perspective view of a fusible link directly mounted on a battery described in PTL 1.

Then, a component of FIG. 1 differs from a component of FIG. 18 in a protective cap 500 (the protective cap 50 in FIG. 18). Therefore, the protective cap 500 will hereinafter be described.

The protective cap 500 is means for covering the fusible link 30 and is molded by resin and thereby prevents atmospheric dust etc. from entering and also prevents the human body from making contact to get an electric shock or cause an electric leak. In the invention, a protective cap region as an extension of a power source side stud bolt of the protective cap 500 is provided with a tool insertion hole 500A as described in FIGS. 2A and 2B.

Figure 2A:
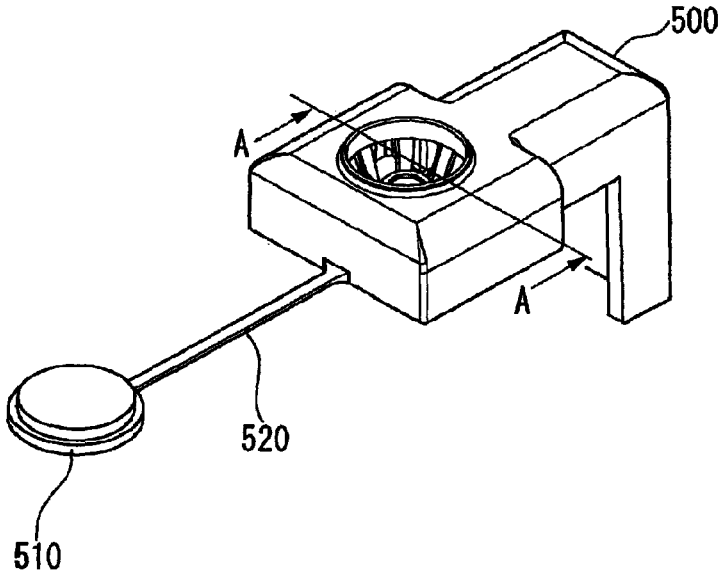
FIGS. 2A and 2B are diagrams describing the protective cap according to the invention.

In FIG. 2A, the tool insertion hole 500A is bored in the protective cap 500, and at the time of tightening a nut, a tool is inserted into this tool insertion hole 500A and the nut is tightened and at the time of normal use, the tool insertion hole 500A is closed with a lid 510. The lid 510 is constructed so as not to be lost by coupling the lid 510 to the protective cap 500 using a coupling band 520. The tool is an impact wrench for example.

Figure 2B:
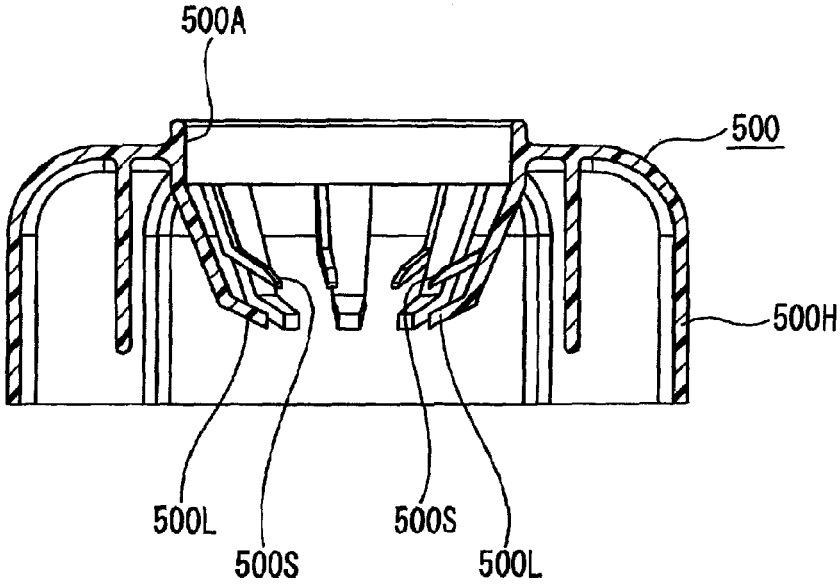

As shown in a longitudinal sectional view of the protective cap 500 of FIG. 2B, the tool insertion hole 500A is formed at a protective cap part in the vicinity of the upper center of a protective cap housing 500H and an inside diameter of the tool insertion hole 500A is substantially equal to an outside diameter of the impact wrench.

A nut holder is provided inside the protective cap 500. As a nut holder, two kinds of lances 500L, 500S are respectively extended from the circumferential lower portion toward the inner center of the tool insertion hole 500A. The lances 500L are formed long and the lances 500S are formed short. In other words, the lances 500S are shorter than the lances 500L. In addition, the lances may lengthy supports.

Figure 3:
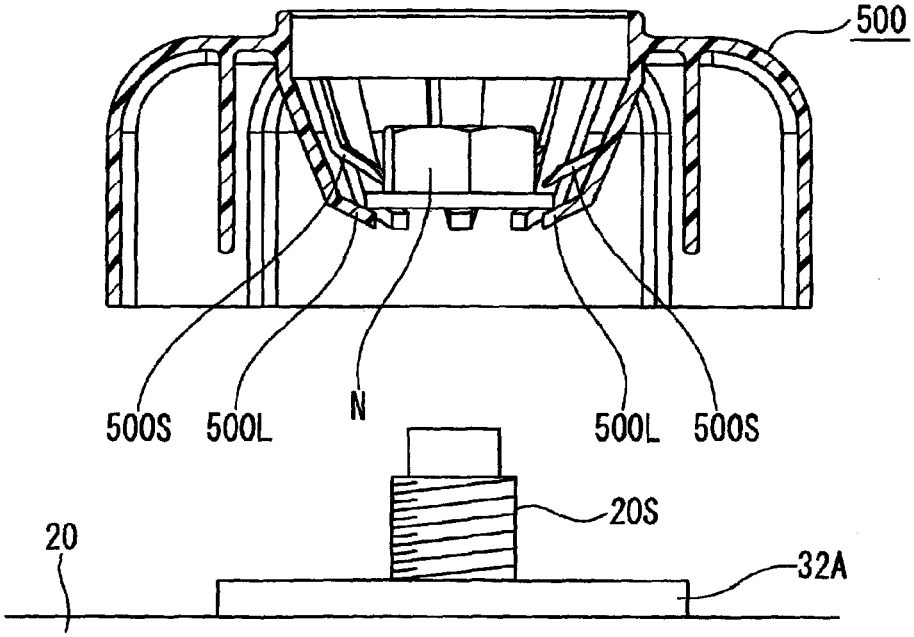
FIG. 3 is a longitudinal sectional view showing a state of attaching a nut to the protective cap according to the invention.

In FIG. 3, the long lances 500L support the lower end side of a nut N and the short lances 500S press the upper end side of the nut N and thereby, the nut N is held horizontally so as not to come off. The long lances 500L hold a first face of the nut N at a side of the fusible link 30. The short lances 500S hold a second face of the nut N opposite to the first face. A power source side stud bolt 20S of the battery terminal 20 in a state of inserting the power source side stud bolt 20S into a connection hole of a power source side terminal block 32A is positioned just under the nut N.

The protective cap part is disposed on an extension of an axis of a stud bolt 20S. The nut holder holds the nut N in a state where an axis of the nut N is parallel to the axis of the stud bolt 20S.

Figure 4:
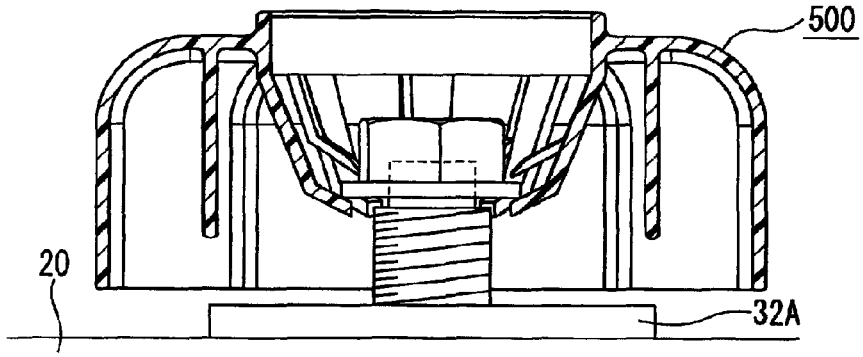
FIG. 4 is a longitudinal sectional view showing a state of fitting the protective cap according to the invention into the fusible link.

In FIG. 4, when the protective cap 500 is descended and is fitted into the fusible link 30, the nut N horizontally held by the long lances 500L and the short lances 500S is positioned just over the power source side stud bolt 20S. Longitudinal dimensions of the long lances 500L and the short lances 500S are determined so as to achieve such positioning.

Figure 5:
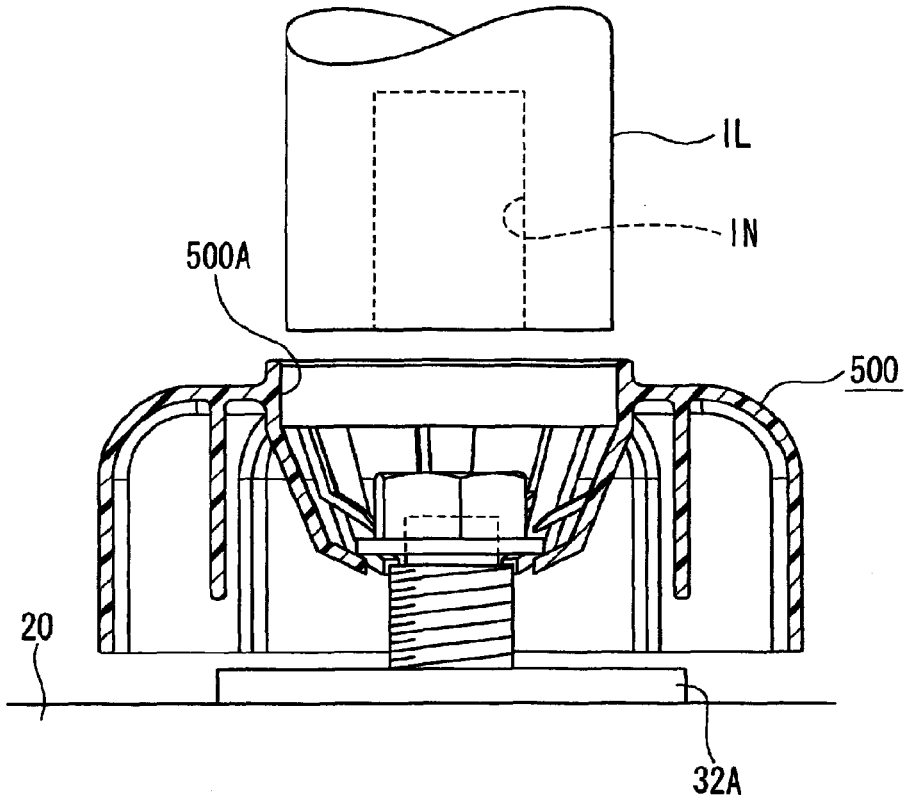
FIG. 5 is a longitudinal sectional view showing a state in which a wrench approaches an upper portion of the protective cap of FIG. 4.
Figure 6:
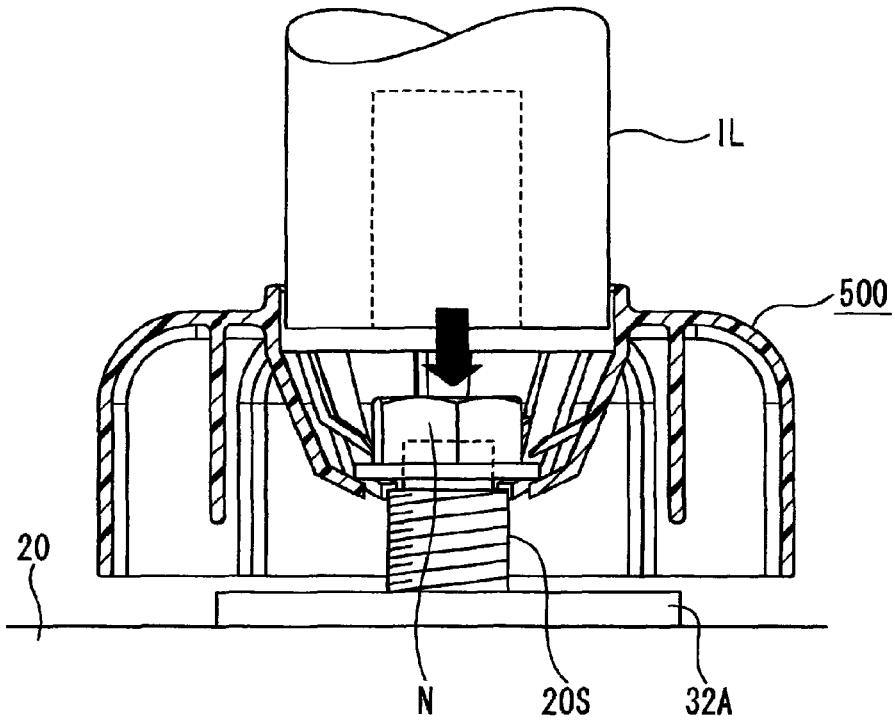
FIG. 6 is a longitudinal sectional view showing a state in which the wrench of FIG. 5 descends and enters the protective cap from a tool insertion hole of the protective cap and starts to tighten the nut.

As shown in FIG. 5, an impact wrench IL is brought just over the tool insertion hole 500A of the protective cap 500 of FIG. 4 and is descended. Since a size of a diameter of the tool insertion hole 500A is formed in a size in which the impact wrench IL can just pass through the tool insertion hole, when the impact wrench IL is inserted into the tool insertion hole 500A with the same diameter, the impact wrench IL enters perpendicularly to the tool insertion hole 500A as shown in FIG. 6 and oblique travel could never occur.

Further, the nut N is horizontally held by the long lances 500L and the short lances 500S, so that the impact wrench IL moves perpendicularly to the nut N.

Figure 7:
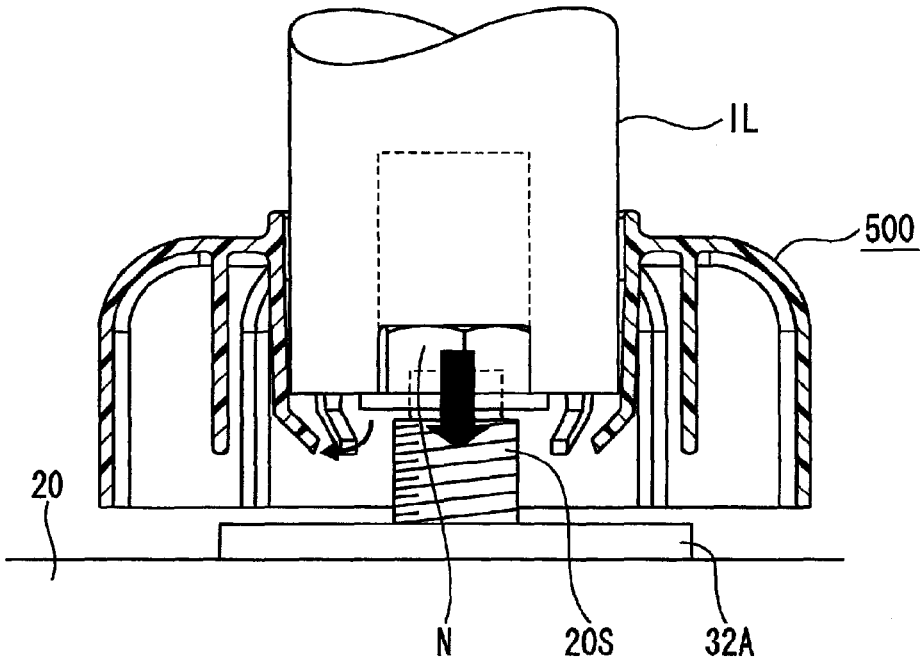
FIG. 7 is a longitudinal sectional view showing a state in which the wrench is tightening the nut.

FIG. 7 shows a state in which the impact wrench IL houses the nut N in its own internal space. In a stage in which the impact wrench IL houses the nut N, the long lances 500L and the short lances 500S for horizontally holding the nut N complete a role of the horizontal holding, and retract from a path of the impact wrench IL by a descent of the impact wrench IL, and do not interfere with passage of the impact wrench IL.

Figure 8:
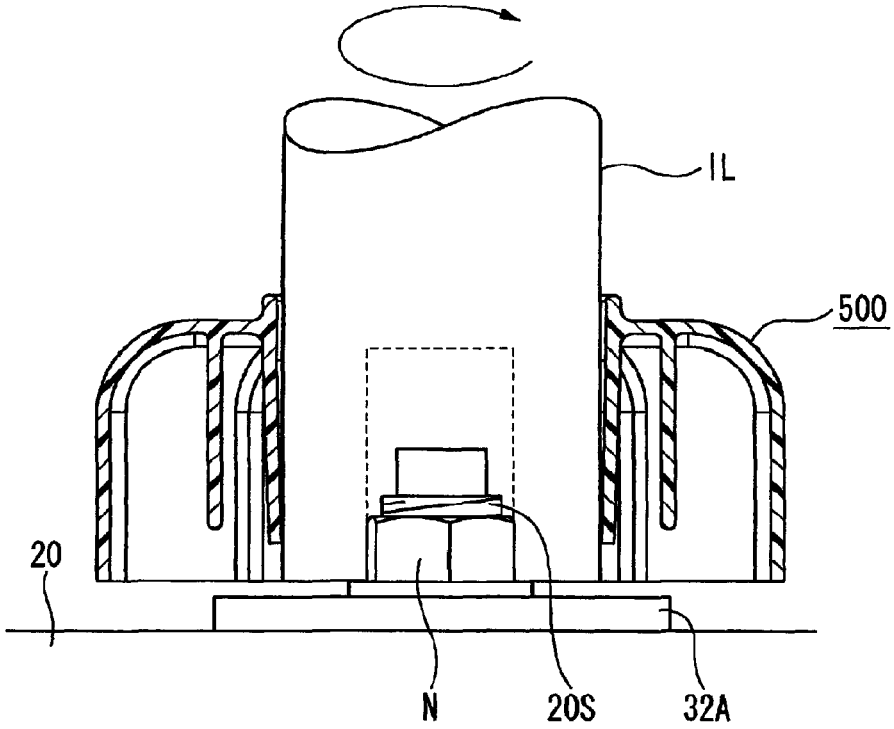
FIG. 8 is a longitudinal sectional view showing a state in which the wrench completes tightening the nut.

Then, when the impact wrench IL is rotated, the nut N descends while rotating a surface of the power source side stud bolt 20S and finally as shown in FIG. 8, the nut N reaches the power source side terminal block 32A, and the fusible link 30 is horizontally tightened to the battery terminal 20 without obliquely tightening the fusible link 30.

Figure 9:
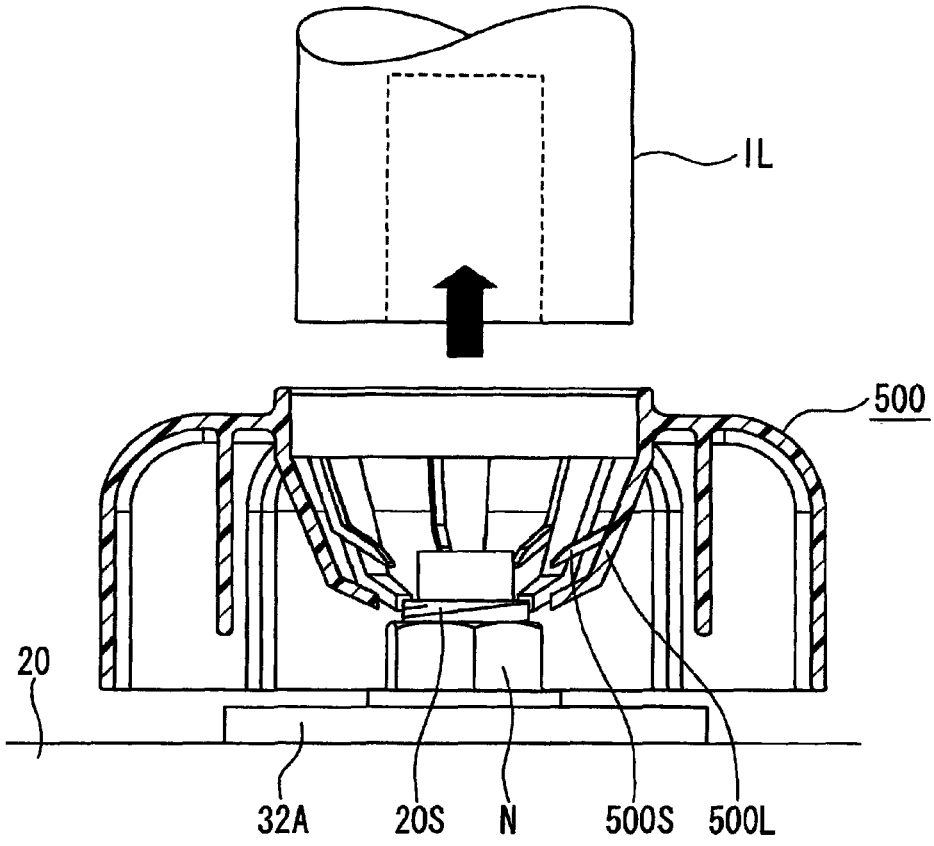
FIG. 9 is a longitudinal sectional view showing a state in which the wrench retracts from the protective cap from the state of FIG. 8.
Figure 10:
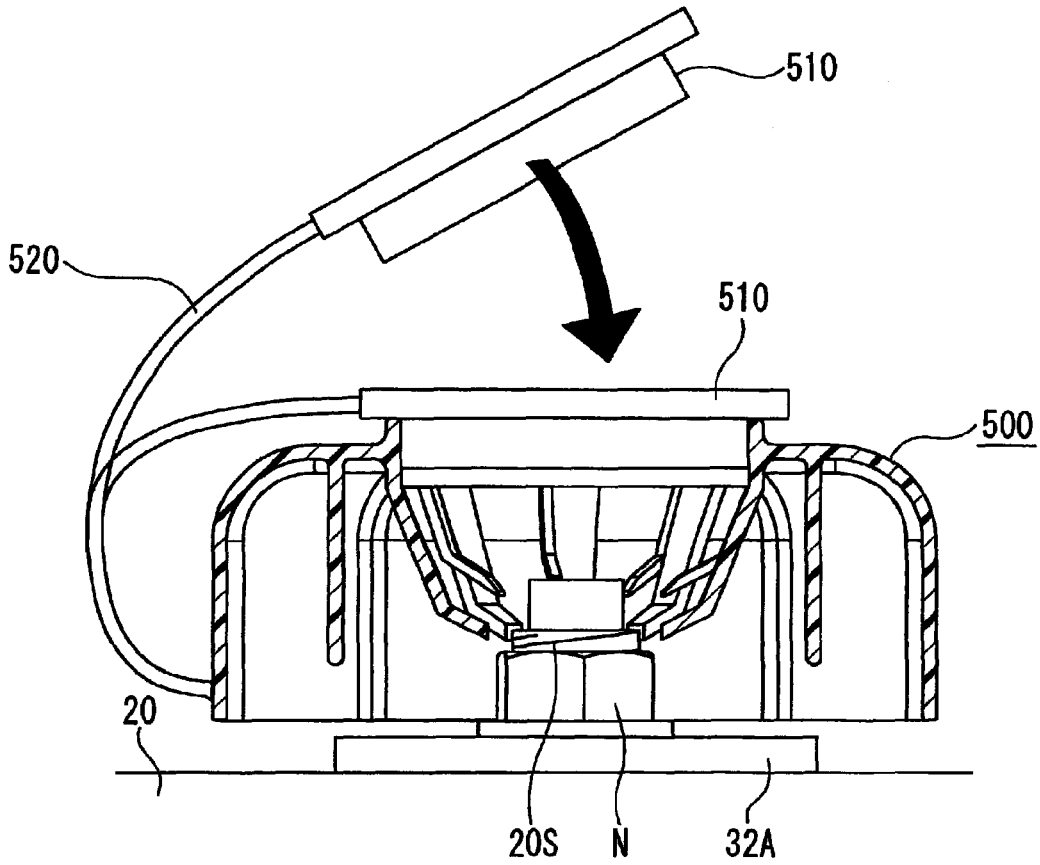
FIG. 10 is a longitudinal sectional view showing a state of attaching a lid to the tool insertion hole.

Thereafter, when the impact wrench IL is detached from the protective cap 500 as shown in FIG. 9 and the lid 510 is fitted into the tool insertion hole 500A as shown in FIG. 1, attachment of the fusible link 30 to the battery terminal 20 and fitting of the protective cap 500 into the fusible link 30 are completed.

As described above, use of the protective cap according to the invention enables good workability and can prevent oblique tightening of the fusible link without occurrence of the oblique tightening in the case of tightening the bolt and the nut.

A second embodiment is the invention constructed so that backlash of a protective cap can be prevented in the protective cap of the first embodiment.

In the first embodiment, it is necessary to create clearance between the protective cap 500 and the fusible link 30 in consideration of a locus of a lock part at the time of fitting in order to fit the protective cap 500 into the fusible link 30. Because of that, the protective cap 500 has backlash with respect to the fusible link 30 in a state of fitting.

Figure 11A:
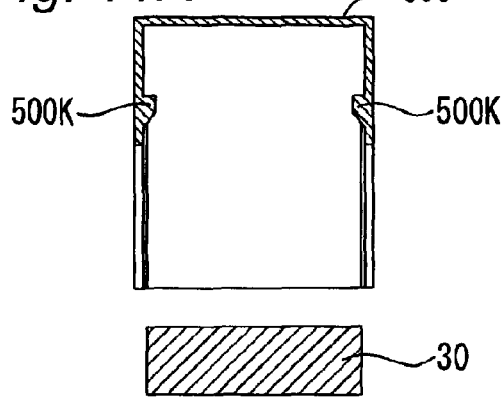
FIGS. 11A to 11F are conceptual diagrams describing a cause of occurrence of backlash.
Figure 11B:
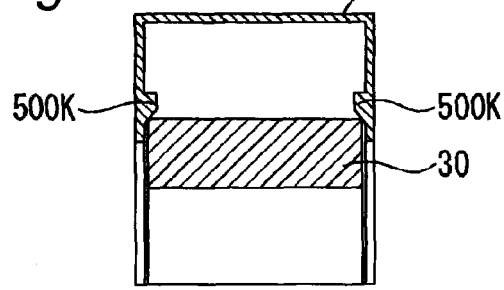
Figure 11C:
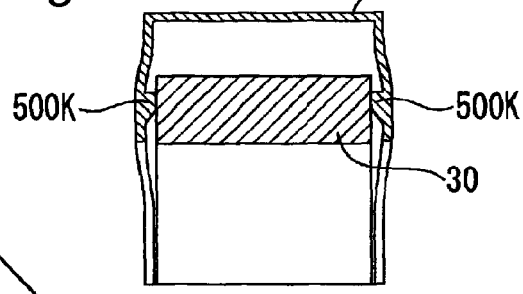
Figure 11D:
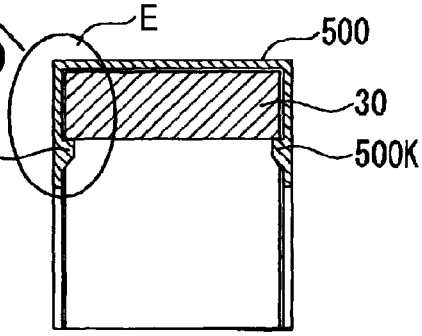
Figure 11E:
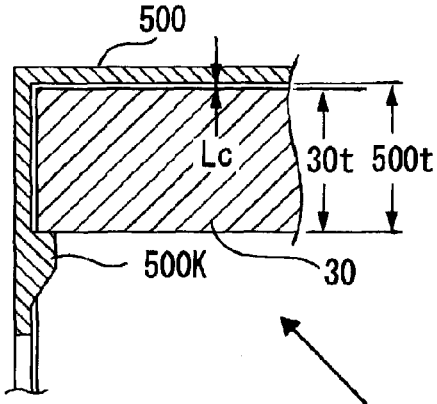
Figure 11F:
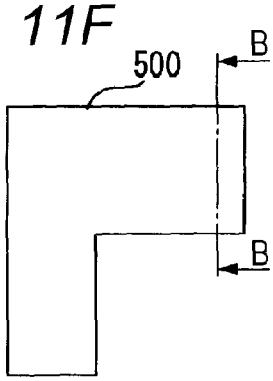

FIGS. 11A to 11F are conceptual diagrams describing a reason of occurrence of backlash. FIG. 11F is a side diagram of a state of fitting the protective cap 500 into the fusible link 30. FIG. 11D is a sectional diagram taken on line B-B of FIG. 11F. FIGS. 11A to 11D are diagrams showing a fitting procedure for fitting the protective cap 500 into the fusible link 30. FIG. 11A is the diagram before fitting. FIG. 11B is the diagram just before fitting. FIG. 11C is the diagram during fitting. FIG. 11D is the diagram of the completion of fitting. FIG. 11E is an enlarged diagram of a portion E of FIG. 11D.

When the protective cap 500 is descended from an upper portion of the fusible link 30 (FIG. 11A), engaging protrusions 500K of the protective cap 500 make contact with a side surface of the fusible link 30 (FIG. 11B). When the engaging protrusions 500K make contact with the side surface of the fusible link 30, the protective cap 500 descends with the protective cap 500 expanded (FIG. 11C). Then, when the engaging protrusions 500K of the protective cap 500 get over the side surface of the fusible link 30 and reach the lower end, the protective cap 500 returns from the expanded state to the original shape by elasticity of the material itself of the protective cap 500 (FIG. 11D).

In this case, as shown in FIG. 11E, when a length 500*t* from the roof inside of the protective cap 500 to the engaging protrusions 500K is exactly equal to a thickness 30*t* of the fusible link 30, the engaging protrusions 500K make frictional contact with a lower surface of the fusible link 30 and the protective cap 500 cannot return to the original shape. Therefore, the length 500*t* requires a clearance slightly larger than the thickness 30*t* of the fusible link 30. Consequently, the engaging protrusions 500K do not make frictional contact with the lower surface of the fusible link 30, so that the protective cap 500 can return to the original shape as shown in FIG. 11D.

However, in a state in which the protective cap 500 returns to the original shape and fitting is completed, the length 500*t* has the clearance slightly larger than the thickness 30*t* of the fusible link 30, so that there is backlash between the protective cap 500 and the fusible link 30. Since this backlash causes problems such as vibration or noise, the second embodiment is constructed so as to prevent the backlash.

Figure 12:
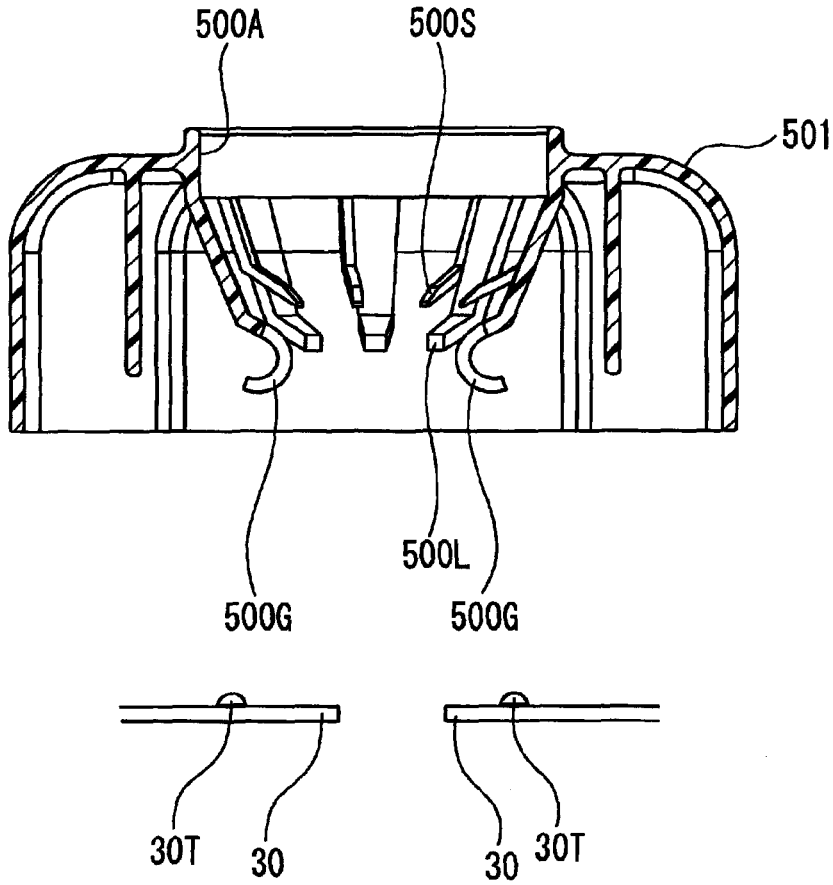
FIG. 12 is a longitudinal sectional view of a protective cap according to a second embodiment.

FIG. 12 is a longitudinal sectional view describing a protective cap capable of preventing backlash according to the second embodiment.

In FIG. 12, numeral 501 is the protective cap according to the second embodiment. The second embodiment has the following structure in each of the sides of the protective cap 501 and a fusible link 30.

Figure 17:
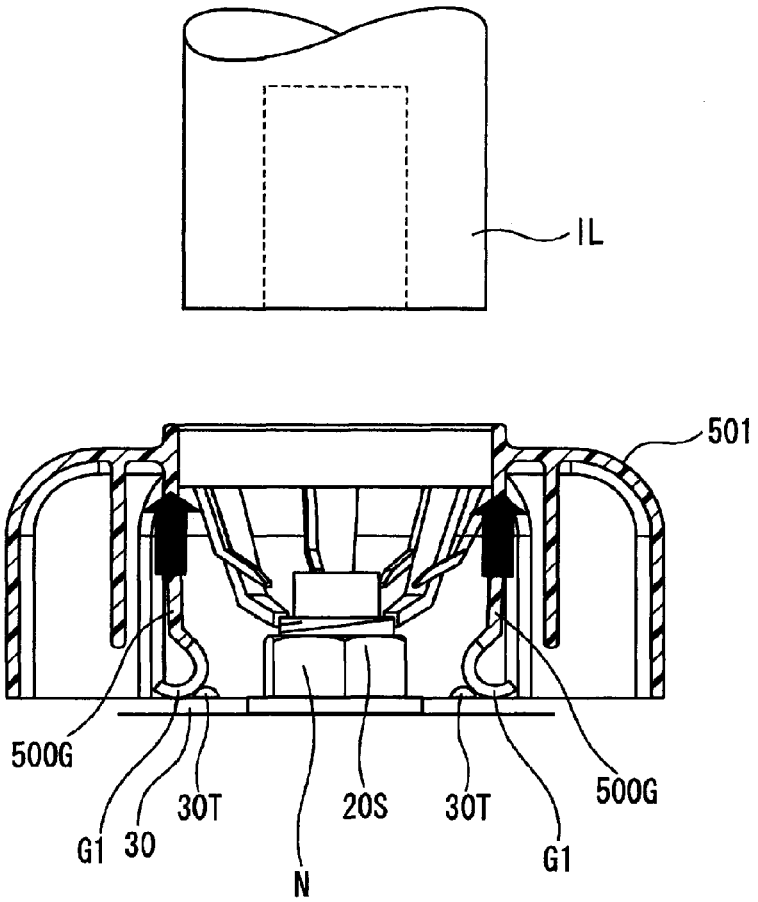
FIG. 17 is a diagram describing an operation of the protective cap of the second embodiment, and is the diagram showing a state of detaching the impact wrench.

The protective cap 501 of the second embodiment differs from the protective cap 500 of the first embodiment in that an anti-backlash lance 500G which is a third lance is further included. The anti-backlash lance 500G is longer than the long lances 500L, and has a length in which a top G1 of the anti-backlash lance 500G can make contact with a surface of the fusible link 30 when the anti-backlash lance 500G expands and turns directly downward as can be seen from FIG. 17 showing a use state. Such plural anti-backlash lances 500G are extended downward in a circumferential direction of a tool insertion hole 500A of the protective cap 501.

A detent protrusion 30T is disposed in the fusible link 30.

That is, the detent protrusions 30T are disposed in contact regions of the fusible link 30 whose surface makes contact with the tops G1 of the anti-backlash lances 500G as shown in FIG. 17 of a use state (described below). Thus, the detent protrusions 30T inhibit the anti-backlash lances 500G expanding and turning directly downward from returning to the original state.

Figure 13:
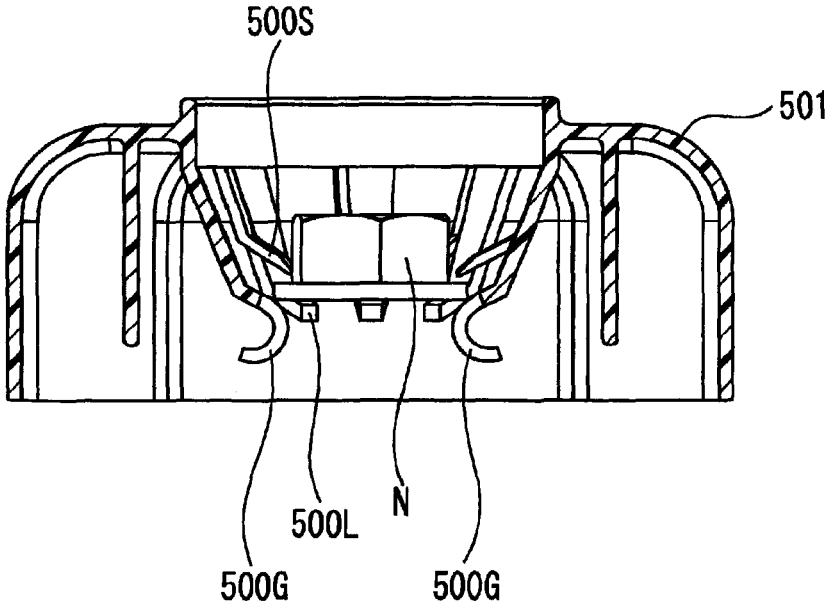
FIG. 13 shows a state of horizontally holding a nut on the protective cap of the second embodiment.

An operation of the protective cap 501 of the second embodiment will be described using FIGS. 13 to 17. In FIG. 13, the long lances 500L support the lower end side of a nut N and short lances 500S press the upper end side of the nut N and thereby, the nut N is held horizontally so as not to come off. In this state, the tops of the anti-backlash lances 500G extend further obliquely downward from the lower end of the nut N.

Figure 14:
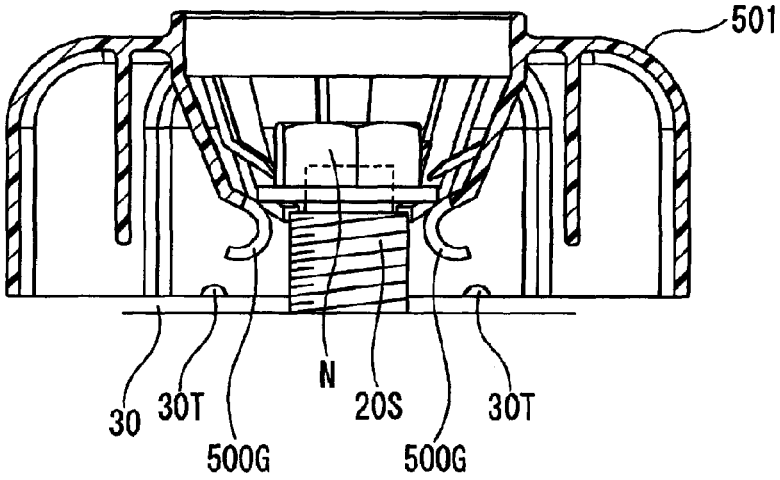
FIG. 14 is a diagram describing an operation of the protective cap of the second embodiment, and is the diagram showing a state of setting a long dog point of a stud bolt inside the nut of the state of FIG. 13.

In FIG. 14, the protective cap 501 is descended on the fusible link 30, and a long dog point of a power source side stud bolt 20S is set inside the nut N horizontally held by the long lances 500L and the short lances 500S. At this time, the tops of the anti-backlash lances 500G still extend obliquely downward from the lower end of the nut N.

Figure 15:
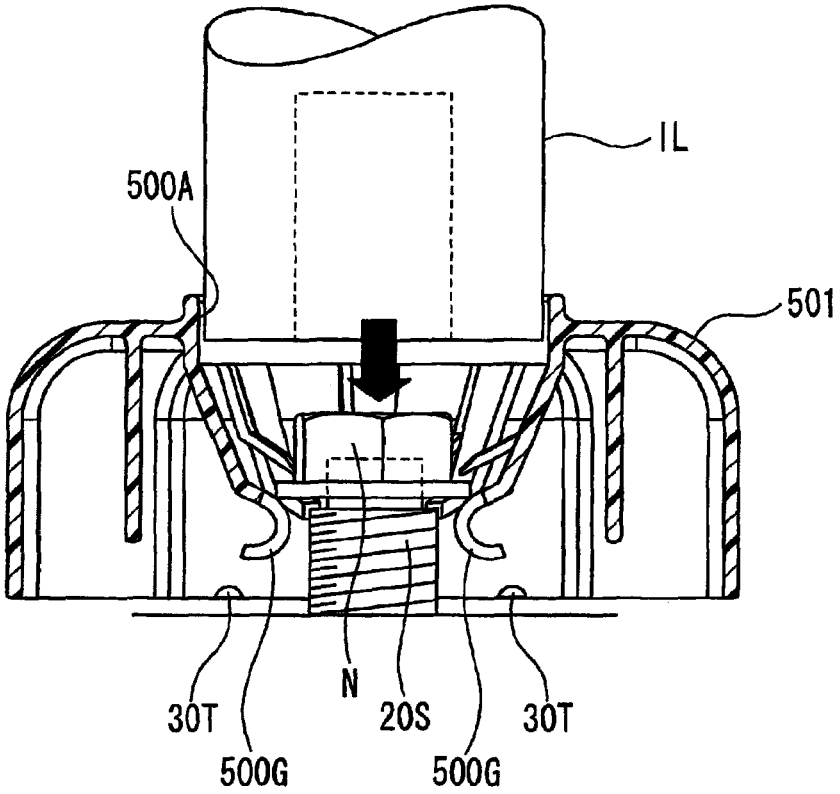
FIG. 15 is a diagram describing an operation of the protective cap of the second embodiment, and is the diagram showing a state of descending an impact wrench.

In FIG. 15, when an impact wrench IL is descended, as described in the first embodiment, a size of a diameter of the tool insertion hole 500A is formed in a size in which the impact wrench IL can just pass through the tool insertion hole, so that the impact wrench IL enters perpendicularly to the tool insertion hole 500A and oblique travel does not occur. At this time, the tops of the anti-backlash lances 500G still extend obliquely downward from the lower end of the nut N.

Figure 16:
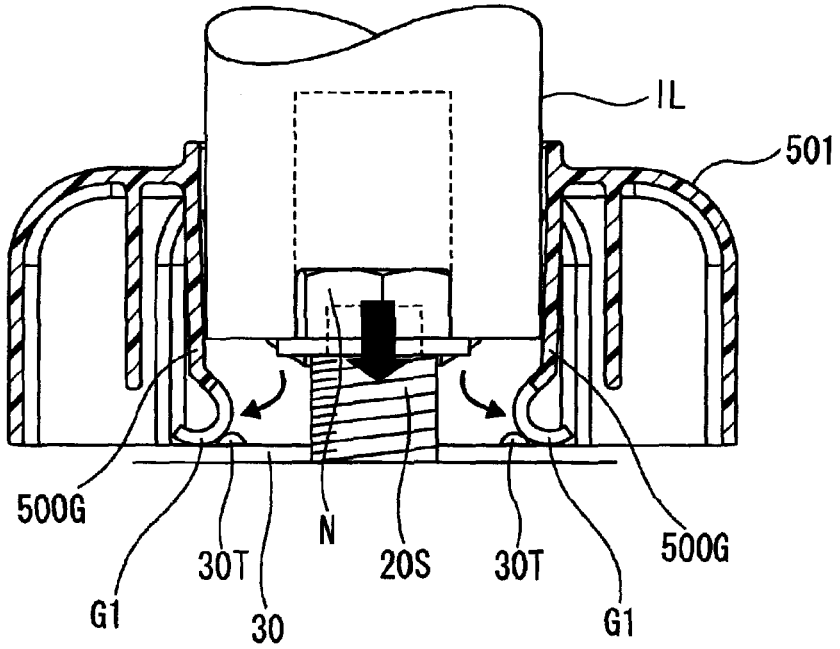
FIG. 16 is a diagram describing an operation of the protective cap of the second embodiment, and is the diagram showing a state in which anti-backlash lances are pushed by the impact wrench and retract in a perpendicular direction.

In FIG. 16, when the impact wrench IL is turned and moves downward, the nut N is horizontally tightened to the power source side stud bolt 20S without occurrence of the oblique travel. At this time, the anti-backlash lances 500G are pushed by the impact wrench IL and the tops of the anti-backlash lances 500G retract in a perpendicular direction from the oblique lower portion. Then, the tops G1 of the anti-backlash lances 500G finally get over the detent protrusions 30T and are positioned in the outside of the detent protrusions 30T.

Thereafter, as shown in FIG. 17, when the impact wrench IL is detached from the protective cap 501, return of the tops G1 of the anti-backlash lances 500G is inhibited by the detent protrusions 30T, so that the anti-backlash lances 500G cannot return to the original state and the anti-backlash lances 500G abut on the fusible link 30 in an expanded state. In this state, the anti-backlash lances 500G always upward lift the protective cap 501 from the fusible link 30 as shown in arrows by an elastic force had by material of the anti-backlash lances themselves, so that backlash is prevented even in the presence of clearance. Also, before the protective cap 501 is assembled, the anti-backlash lances 500G are positioned inside the protective cap 501, so that damage can be prevented.

As described above, use of the protective cap according to the first embodiment enables good workability and prevents oblique tightening in the case of tightening the bolt and the nut and further, the anti-backlash lances of the second embodiment prevent the backlash.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the inventions as defined by the appended claims.

The present invention is extremely useful in forming a protective cap in which workability is good and oblique tightening of a fusible link can be prevented.

What is claimed is:

1. A protective cap for protecting a fusible link formed with a connection hole, comprising:

a protective cap part, disposed on an extension of an axis of a stud bolt of a power source, and formed with a tool insertion hole into which a tool used for fitting a nut with the stud bolt is inserted, the stud bolt inserted through the connection hole; and a nut holder, provided inside the protective cap part, and configured to hold the nut in a state where an axis of the nut is coaxial to the axis of the stud bolt.

2. The protective cap as set forth in claim 1, wherein an inner diameter of the tool insertion hole is equal to an outer diameter of the tool.

3. The protective cap as set forth in claim 1, wherein the nut holder includes a plurality of lances which are erected inside the protective cap from a periphery of the tool insertion hole.

4. The protective cap as set forth in claim 3, wherein the lances include first lances and second lances which are shorter than the first lances, the first lances are configured to hold a first face of the nut at a side of the fusible link, and the second lances are configured to hold a second face of the nut opposite to the first face.

5. The protective cap as set forth in claim 4, wherein the lances further include third lances, and the third lances are configured to come in contact with the fusible link and to have an elastic force in a direction separating the protective cap from the fusible link in a state where the protective cap is attached to the fusible link.

6. The protective cap as set forth in claim 1, further comprising:

a lid, configured to close the tool insertion hole; and a coupling band coupling the lid to the protective cap part.

* * * * *